US006028048A

United States Patent [19]

Takahashi et al.

[11] Patent Number: 6,028,048

[45] Date of Patent: Feb. 22, 2000

[54] DETERGENT COMPOSITION CONTAINING AN AMINODICARBOXYLIC ACID-N, N-DIALKANOIC ACID OR ITS SALT

[75] Inventors: Chie Takahashi; Kouji Yanagihara; Kyoko Morikawa; Hiroshi Saito; Norio Arai, all of Tokyo; Makoto Saito; Tohru Yamamoto, both of Kawasaki, all of Japan

[73] Assignees: Daisan Kogyo Co., Ltd.; Showa Denko K.K., both of Tokyo, Japan

[21] Appl. No.: 09/002,005

[22] Filed: Dec. 31, 1997

[30] Foreign Application Priority Data

Mar. 12, 1997 [JP] Japan ..... 9-074646
Mar. 12, 1997 [JP] Japan ..... 9-074647

[51] Int. Cl.[7] ..... C11D 3/33; C11D 1/74

[52] U.S. Cl. ..... 510/490; 510/245; 510/276; 510/289; 510/332; 510/365; 510/421; 510/434; 510/470; 510/477; 510/490; 510/499; 510/531; 510/533

[58] Field of Search ..... 510/245, 490, 510/276, 470, 289, 332, 365, 421, 434, 477, 499, 531, 533

[56] References Cited

U.S. PATENT DOCUMENTS 4,349,447 9/1982 Noguchi et al. ..... 252/117
4,963,284 10/1990 Novokovic et al. ..... 252/108

FOREIGN PATENT DOCUMENTS 68868 1/1983 European Pat. Off. .
154380 9/1985 European Pat. Off. .
702079 3/1996 European Pat. Off. .
714977 6/1996 European Pat. Off. .
9100336 1/1991 WIPO .

*Primary Examiner*—Yogendra Gupta
*Assistant Examiner*—Charles Boyer
*Attorney, Agent, or Firm*—Sughrue, Mion, Zinn, Macpeak & Seas, PLLC

[57] ABSTRACT

Detergent compositions comprising aminodicarboxylic acid-N,N-dialkanoic acid or its salt (component A) and a synthetic surface active agent having microbial degradability (component B).

In particular, in the case where an alkali salt of polyoxyalkylene alkylether acetic acid or alkyl polyglycoside is used as the surface active agent (component B), the detergent compositions exhibit excellent washing effect without forming metallic soap even in washing water with high hardness, and also show high solubility even under the condition of low water temperature, and have excellent microbial degradability. Thus, the detergent compositions are particularly suitable for washing fabrics. Further, in the case where synthetic anionic and/or nonionic surface active agent is used as the surface active agent (component B), influence of corrosion to light metals is small. Accordingly, the detergent compositions are suitable for washing light metals, and also they have excellent foaming property and therefore can be applied to foam cleaning.

12 Claims, No Drawings

DETERGENT COMPOSITION CONTAINING AN AMINODICARBOXYLIC ACID-N, N-DIALKANOIC ACID OR ITS SALT

BACKGROUND ART

1. Field of the Invention

The present invention relates to a detergent composition containing a specific aminodicarboxylic acid-N,N-dialkanoic acid or its salt, and a synthetic surface active agent. More particularly, it relates to a detergent composition which does not form metallic soap in washing water with high hardness, and gives little corrosive effect to the surface of such light metal materials, e.g., aluminum and others, and exhibits high solubility even in water with low temperature, leading to an excellent washing performance, and, moreover, is excellent in biodegradability (microbial degradability), and, furthermore, is particularly suitable for washing clothes and the hard surface of various facilities and apparatuses made of light metal materials.

2. Background of the Invention

In recent years, environmental keeping has strongly been advocated, and microbial degradability of both synthetic surface active agents and builders which are used for washing, and also eutrophication by phosphorus compounds has been taken up as social problems. Therefore, there is a tendency recently that cleaning agents for clothes change from synthetic detergents to soap compositions.

Soap compositions have excellent microbial degradability. But though they show excellent washing effect if they are put in water with good quality and relatively high temperature, they are likely to get influenced by the hardness or the temperature of washing water. Namely, if water with high hardness or low temperature is used, metallic soap insoluble to water is formed, or soap compositions themselves become hard to dissolve in water and change to insoluble materials, resulting in decrease in washing effect. Those insoluble materials are deposited on fiber surface, e.g., when at washing fabrics, and thus deposited materials are not removed even if rinsed with water, resulting in deterioration of the finish after washing. This is the reason why the transfer from synthetic detergents to soap compositions is retarded.

As a means of solving the problem involved in the above-described soap compositions, blending soap compositions with the chelating agent, such as an alkali salt of ethylenediamine tetraacetic acid (EDTA) and alumina silicate (zeolite) has conventionally been used. However, the said EDTA chelating agent is poor in microbial degradability and, as a result, a soap composition containing EDTA becomes also poor in microbial degradability. Moreover, the zeolite chelating agent has weak sequestration and, as a result, water-insoluble metallic soap is formed when a soap composition containing zeolite is used in water with high hardness. Furthermore, even if those chelating agents are contained in soap compositions, this fact does not improve solubility of the soap composition in water with low temperature, and thus the problem of water-insolubility remains unsolved.

Recently, as the interest in protection of limited resources has increased, development and utilization of resources which can be reclaimed or recovered has become a new subject. In particular, regarding kitchen detergents, a change of an anionic surface active agent over to a biodegradable nonionic surface active agent has been progressing. Since the raw material source of this nonionic surface active agent is plant, it has excellent microbial degradability and is mild to skin, namely, less irritant to skin and, in addition, has excellent degreasing property. Therefore, the nonionic surface active agent is suitable for synthetic detergents for kitchen use, mainly for washing tablewares. However, when the nonionic surface active agent is used alone, washing effect is low as a synthetic detergent for fabrics. Therefore, for the purpose of raising the washing effect of this surface active agent, a mixture of a surface active agent and a builder compound has been used. Though phosphorus compounds have conventionally been used as the builder compound of this kind, the use of such compounds is a cause of unpreferable eutrophication and, therefore, a chelating agent showing calcium sequestration, such as alumina silicate (zeolite), high molecular carboxylate with polyacrylate being a representative example, nitrilotriacetate (NTA) and ethylenediamine tetraacetate (EDTA) have been used instead in recent years.

However, the alumina silicate is weak in sequestration and, as a result, a detergent using the alumina silicate greatly decreases its washing effect when used in water with high hardness. Moreover, the alumina silicate is water-insoluble. Therefore, when a detergent containing the alumina silicate is drained off, the alumina silicate is deposited in a sludge state on the bottoms of sewage treatment plants or the beds of rivers and others, which will cause a new environmental problem. The above-described high molecular carboxylate and ethylenediamine tetraacetate as a chelating agent has poor microbial degradability and, as a result, a synthetic detergent containing those chelating agents, such as high molecular carboxylate, is also poor in microbial degradability. Regarding nitrilotriacetate, though its microbial degradability is excellent and its environmental problem has been solved, it is regarded as a builder hard to employ, from the standpoints of safety and washing performance. Moreover, most of surface active agents which have conventionally been used as the main component of the above-described known detergents use hydrocarbons derived from petroleum as raw material sources which can not be reclaimed or recovered. Therefore, if the importance of resource protection in future is taken into consideration, those surface active agents involve a big problem.

Furthermore, various light metal materials including aluminum material have recently been used in packing apparatus of drinks and food processing facilities which requires precision, or in vehicles, aircrafts, containers, and the like which all require light weight. But it is necessary to wash the outer surface, i.e., hard surface, of apparatuses, facilities, vehicles, aircrafts, containers and the like which use light metal materials with a detergent having high washing effect.

Detergents containing chelating agents, such as sodium ethylenediamine tetraacetate (EDTA), and having a high pH value, have conventionally been used as detergents having high washing effect.

However, if such detergent as having a high washing effect contacts the surface of a light metal material for a long period of time by repeated washing, there may occur such problems that the surface of the light metal material gets corroded. Or whitening or blacking phenomena occurs, resulting in disappearance of surface luster, or the detergent dissolves the surface and makes holes on it.

In addition, in order to efficiently wash a wide area of hard surface, foam cleaning technique was recently employed. In this technique, an anionic surface active agent is incorporated in a detergent for the purpose of increasing foaming.

However, the anionic surface active agent is greatly influenced by hardness of water used in dilution and, if it is diluted with water having high hardness, the anionic surface active agent becomes insoluble and foaming does not occur and, at the same time, washing performance drops.

In order to solve those problems, a chelating agent, such as sodium ethylenediamine tetraacetate (EDTA), is incorporated in the detergent which contains an anionic surface active agent in the same manner as described above. However, the detergent containing a chelating agent, such as EDTA, causes the above problems at light metal materials.

Thus, in washing light metal materials, such as aluminum, if it is aimed to increase washing effect of the detergent by adding a chelating agent, the same problem as mentioned above occurs on the surface of light metal materials.

Therefore, as a detergent for washing the surface of light metal materials, a detergent containing selected nonionic surface active agent which has lower foaming property but gets less influenced by the hardness of diluting water and having pH value being adjusted as close to neutral, or a detergent added with a silicate which is effective to prevent light metals from corrosion, and unnecessary to contain a chelating agent such as EDTA, is required.

However, the detergent of this type has low washing performance. Therefore, at washing, it is necessary for the detergent to contact the surface of light metal material for a long period of time, or to employ physical means, such as rubbing the surface. Further, since the foaming property is low, the said detergent is not suitable for foam washing which is good at washing the large area. When an anionic surface active agent is used, a detergent which does not contain a chelating agent, such as EDTA, is influenced by the hardness of diluting water and becomes difficult to get foams. Therefore, a large amount of a surface active agent is necessary in the detergent used for foam washing.

Furthermore, when a detergent contains a silicate, the silicate easily deposits on a metal surface, becoming a core of stains, and is likely to stain easily the surface after washing.

OBJECTS OF THE INVENTION

The object of the present invention is to provide a detergent composition which does not form metallic soap even in washing water with high hardness, and shows excellent washing effect with high solubility in water at low temperature, and has excellent microbial degradability, and improves disadvantages involved in the prior art, and is particularly suitable for washing fabrics.

Another object of the present invention is to provide a detergent composition which can use reclaimable and recoverable plants as its raw material sources, and contributes to the protection of resources.

An additional object of the present invention is to provide a detergent composition for washing light metals which does not use a chelating agent, such as EDTA, or a silicate, and gives less influence of corrosion to a light metal surface, and shows excellent washing effect and foaming property even when water with high hardness is used for diluting or washing, and has excellent microbial degradability, and is particularly suitable for washing surface of various facilities or apparatuses comprising light metal materials, and improves the disadvantages involved in the prior art.

SUMMARY OF THE INVENTION

As a result of an extensive investigation in view of the above problems, the present inventors have solved the above problems by using a detergent composition comprising a specific aminodicarboxylic acid-N,N-dialkanoic acid or its salt, such as an alkali salt of glutamic acid-N,N-diacetic acid, and a synthetic surface active agent.

According to the present invention, the following detergent compositions are provided:

1) A detergent composition characterized in comprising an aminodicarboxylic acid-N,N-dialkanoic acid or its salt (component A), represented by the following formula:

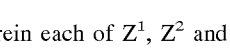

$$MOOC—CHZ^1—NZ^2Z^3$$

wherein each of $Z^1$, $Z^2$ and $Z^3$ independently represents a COOM-containing group, wherein M represents a hydrogen atom, sodium, potassium, amine or ammonium ion; and a synthetic surface active agent having a microbial degradability (component B).

2) The detergent composition as described in 1) above, wherein the rate of decomposition of the detergent composition when said composition is diluted with water to COD 500 ppm, an activated sludge is added thereto and then the resulting mixture is aerated for 7 days is 85% and more (COD being less than 75 ppm).

3) The detergent composition as described in 1) above, wherein the component A is an alkali salt of glutamic acid-N,N-diacetic acid.

4) The detergent composition as described in 1) above, wherein the detergent composition is for washing fabrics.

5) The detergent composition as described in 4) above, wherein the component B is an alkali salt of polyoxyalkylene alkylether acetic acid and/or alkyl polyglycoside.

6) The detergent composition as described in 4) above, wherein an alkali salt of polyoxyalkylene alkylether acetic acid is selected from among compounds represented by the following formula (1):

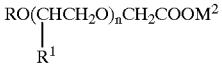

$$RO(\underset{\underset{R^1}{|}}{C}HCH_2O)_nCH_2COOM^2 \quad (1)$$

wherein R represents an alkyl group with the carbon number of between 6 and 20, and $R^1$ represents hydrogen atom or methyl group, and $M^2$ represents sodium, potassium, amine or ammonium ion, and n is the number of between 1 and 6.

7) The detergent composition as described in 5) above, wherein the alkyl polyglycoside is selected from the compounds represented by the following formula:

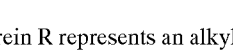

$$RO—Z^4$$

wherein R represents an alkyl group with the carbon number of between 6 and 20, and $Z^4$ represents a polyglycosyl group with the hexose and/or pentose unit of between 1 and 3.

8) The detergent composition as described in 5) above, wherein the composition contains against 1 party by weight of an alkali salt of aminodicarbyxylic acid-N,N-dialkanoic acid:

(1) an alkali salt of polyoxyalkylene alkylether acetic acid in the amount of between 2 and 50 parts by weight;

(2) an alkyl polyglycoside in the amount of between ⅓ and 3 parts by weight; or (3) a mixture of an alkali salt of polyoxyalkylene alkylether acetic acid and alkyl polyglycoside in the amount of between ⅓ and 50 parts by weight, if in said mixture the proportion (weight ratio) of an alkali salt of polyoxyalkylene aklylether acetic acid to alkyl polyglycoside is between 20 to 80 and 80 to 20.

9) The detergent composition as described in 1) above, wherein the composition is used for a washing light metal.

10) The detergent composition as described in 9) above, wherein the detergent composition for washing a light metal comprises an alkali salt of aminodicarboxylic acid-N,N-dialkanoic acid, and synthetic anionic and/or nonionic surface active agent having microbial degradability.

11) The detergent composition as described in 10) above, wherein the blending proportion of an alkali salt of aminodicarboxylic acid-N,N-dialkanoic acid to synthetic anionic and/or nonionic surface active agent is between 1 to 2 and 4 to 1 in weight ratio.

12) The detergent composition as described in 10) above, wherein the solution of the detergent composition has a pH value in the range of between 9 and 11.

13) The detergent composition as described in 10) above, wherein the detergent composition is used in foam cleaning.

DETAILED DESCRIPTION OF THE EMBODIMENTS

Aminodicarboxylic acid-N,N-dialkanoic acid or its salt (A) used in the present invention is a compound represented by the following formula:

$$MOOC—CHZ^1—NZ^2Z^3$$

wherein each of $Z^1$, $Z^2$ and $Z^3$ independently represents a COOM-containing group; wherein each of M independently represents either of a hydrogen atom, sodium, potassium, amine or ammonium ion.

In the above formula, $Z^1$, $Z^2$ and $Z^3$ may either be same with or different from each other, and examples of those groups are found among carboxymethyl group, 1-carboxyethyl group, 2-carboxyethyl group, 3-carboxypropan-2-yl group, their salts, etc. As concrete examples, there are glutamic acid-N,N-diacetic acid, glutamic acid-N,N-dipropionic acid, and their salts. Above all, glutamic acid-N,N-diacetate is especially preferred.

Glutamic acid-N,N-diacetate (A1) which is preferably used in the present invention is a compound represented by the following formula (3):

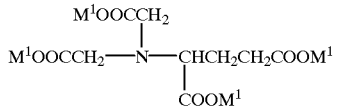

(3)

This glutamic acid-N,N-diacetate is preferably L-glutamic acid-N,N-diacetate. In the above formula (3), each of $M^1$ independently represents an alkali ion, such as sodium and potassium, an amine salt, such as alkanol amine, or an ammonium salt. Among them, an alkali ion, particularly sodium ion, is preferred.

This alkali salt of glutamic acid-N,N-diacetic acid is a derivative of glutamic acid which is amino acid and is obtainable by the conventional production method.

For example, it is synthesized as follows: Glutamic acid, and preferably L-glutamic acid which is amino acid is synthesized by fermenting glucoses originated from plants, such as starch and saccharides, or by hydrolyzing proteins also originated from plants, such as wheat protein and soybean protein. Accordingly, glutamic acid can be synthesized from reclaimable or recoverable glucoses or proteins which are originated from plants as raw material sources. Succeedingly, glutamic acid obtained is cyanomethylated and then hydrolyzed under an alkali condition, thereby obtaining an alkali salt of glutamic acid-N,N-diacetic acid.

An alkali salt of glutamic acid-N,N-diacetic acid obtained through the above process has excellent microbial degradability, and also has excellent calcium ion sequestration. In particular, this sequestration is considerably increased under a weak alkali condition of between pH 9 and 11.

[Detergent composition for clothes]

The surface active agent used in the detergent composition of the present invention is an alkali salt of polyoxyalkylene alkylether acetic acid and/or alkylpolyglycoside, in case of detergent composition for washing fabrics.

An alkali salt of polyoxyalkylene alkylether acetic acid (B1) is a compound represented by the following formula (4) and retains water solubility at low temperature and is completely decomposed by microorganisms in a short period of time.

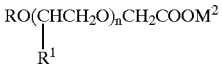

(4)

wherein R represents an alkyl group having the carbon number of between 6 and 20, preferably, between 10 and 18, and $R^1$ represents a hydrogen atom or a methyl group, and n which represents the additional mole number of ethylene oxide ($R^1$ being a hydrogen atom) or propylene oxide ($R^1$ being a methyl group) is between 1 and 6, preferably between 1 and 5. Especially when $R^1$ is a hydrogen atom, n is preferably between 1 and 5, and when $R^1$ is a methyl group, n is preferably between 1 and 3.

In particular, when influences upon washing performance, water solubility and hardness of water, etc. are considered, ether carboxylic acid is preferred, wherein R is an alkyl group having the carbon number of between 10 and 14, and n, i.e., the additional mole number, of alkylene oxide is between 1 and 5 if $R^1$ is a hydrogen atom, and is between 1 and 3, if $R^1$ is a methyl group, and $M^2$ is sodium, potassium, or alkanol amine, preferably, being sodium especially. An alkali salt of polyoxyalkylene alkylether acetic acid may be used either alone or with other salt of the same acid.

A representative example of this compound is sodium polyoxyethylene laurylether acetate. The representative commercially available product is Beaulight LH203 (being a trade name of a product of Sanyo Kasei K.K.).

Alkyl polyglycoside (B2) which is other surface active agent used in the detergent composition mainly for washing fabrics in the present invention is selected from compounds represented by the following formula (5):

$$R^2O—Z^4 \quad (5)$$

wherein $R^2$ represents an alkyl group having the carbon number of between 6 and 20, and $Z^4$ represents a polyglycosyl group having the hexose and/or pentose unit of between 1 and 3.

A nonionic surface active agent represented by the following formula (6) is selected:

(6)

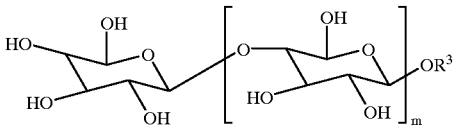

wherein $R^3$ represents an alkyl group having the carbon number of 8 and 16, preferably, 10 and 14, and m, i.e., an average polymerization degree of polyglycoside, is between 1.2 and 1.8, preferably between 1.4 and 1.6. If the carbon number of the alkyl group is less than 8 and, at the same time, m exceeds 1.8, washing effect of the detergent composition is lowered. In addition, if the carbon number of the said group exceeds 16 and, at the same time, m is less than 1.2, water solubility of the detergent composition is lowered.

The carbon number of the said $R^3$ is arbitrarily determined by taking into consideration conditions of some or all of cleaning performance, water solubility, compatibility in the presence of electrolytic ions, skin irritation, foaming ability, etc. and also the kind of detergent and the like. And followed by the above, the average polymerization degree is determined in turn.

In particular, when the detergent composition is applied for washing fabrics, it is preferable that the carbon number of $R^3$ is determined in the range of between 8 and 16, and the average polymerization degree of polyglycoside is determined in the range between 1.4 and 1.6.

Compounds like component (B2) have excellent degreasing performance and foaming ability in a wide range of pH, and have a high standard of safety on human bodies and low skin irritation, and are completely decomposed by microorganisms in a short period of time. For example, at the test using the activated sludge method, their COD decomposed rate showed 85% and more, after they were aerated for 7 days. In addition, they showed to have been nearly completely decomposed by HPLC analysis. Furthermore, under the anaerobic condition, they showed to have been biologically decomposed nearly 100%.

Those compounds are synthesized, for example, from reclaimable or recoverable plants as a raw material source as follows:

First, under the acidic condition, e.g., pH of between 3 and 4, glucose originated from plants, e.g., saccharide from plants, is glycosidated with a lower alcohol, e.g., n-butanol to form a lower alcohol glycoside (n-butanol glycoside), and, secondly, formed lower alcohol glycoside is then put under glycoside exchange with a long chain alcohol originated from plants, such as a natural alcohol which is a derivative of coconut or palm oil. Namely, the compound is synthesized by a two step reaction.

In a detergent composition of the present invention, the blending amount of a surface active agent against 1 part by weight of a salt of aminodicarboxylic acid-N,N-dialkanoic acid (A) is between 2 and 50 parts by weight, and preferably between 12 and 20 parts by weight if the said surface active agent is a salt of polyoxyethylene alkylether acetic acid (B1), and it is between ⅓ and 3parts by weight, and preferably between ½ and 2 parts by weight if the said surface active agent is alkyl polyglycoside (B2) Further, when the mixture of the component (B1) and the component (B2) is used as the surface active agent, the total amount of the said two components against 1 part by weight of component (A) is between ⅓ and 50 parts by weight, and preferably between ½ and 20 parts by weight. The blending proportion thereof, i.e., (B1):(B2) is between 20:80 and 80:20 (weight ratio). Within the range of these blending proportions, the present invention shows a remarkable effect.

The detergent composition of the present invention for washing fabrics as described above may further contain, in addition to the said two components which are essential, alkali salts (buffer agent), such as sodium carbonate, sodium silicate and ethanol amine, in order to maintain the pH value of its solution in an alkali region, and, moreover, if required and necessary, the detergent composition may also contain either of or all of other surface active agents, bleaching agents, enzymes, fluorescent whitening agents, perfumes, solubilizing agents, etc.

In addition, the detergent composition according to the present invention can be prepared either in a granular or liquid form. When at being put into practical use, the detergent composition is preferably diluted with water so that the concentration of an alkali salt of polyoxyethylene alkylether acetic acid (B1) or alkylpolyglycoside (B2) may be brought to the range of between 0.05 and 0.08% on solid basis.

[Detergent Compositions For Light Metals]

An alkali salt of glutamic acid-N,N-diacetic acid (A1) is a derivative of glutamic acid, preferably being L-glutamic acid, which is one of amino acids and has an excellent calcium ion sequestration comparable to that of an alkali salt of ethylenediamine tetraacetic acid (EDTA). This calcium ion sequestration is remarkably improved under an alkali condition with pH of 9 and more. In addition, while an alkali salt of glutamic acid-N,N-diacetic acid has an excellent calcium ion sequestration as a chelating agent, its corrosiveness on light metal materials, such as aluminum, is far less than that of EDTA.

Moreover, an alkali salt of glutamic acid-N,N-diacetic acid is larger in degreasing performance than EDTA, and can easily wash a stain of oil or fat adhered on a hard surface off. Furthermore, if it is used together with either of an anionic surface active agent and a nonionic surface active agent, its degreasing effect greatly increases, and also its foaming ability increases at the same time by the help of a synergistic effect generated between them.

Namely, a surface active agent used in the detergent composition for washing light metal materials in the present invention is a synthetic anionic and/or nonionic surface active agent with biodegradability, and possesses functions not only of washing off organic stains, e.g., oils and fats, proteins, carbohydrates, etc. and inorganic stains, e.g., dusts adhered on a hard surface of light metal materials, but also of acting as a foaming agent.

Examples of synthetic anionic surface active agents are found among following materials: sulfonates, such as linear alkylbenzene sulfonates, α-olefin sulfonates and paraffin sulfonate; sulfates, such as higher alcohol sulfates and higher alkylether sulfate; and the above-described alkali salts of polyoxyalkylene alkylether acetic acid; and others.

Examples of synthetic nonionic surface active agents are found among following materials: polyethyleneglycol-typed nonionic surface active agents, such as higher alcohol ethyleneoxide adducts and linear alkylphenol ethyleneoxide adducts; polyhydric alcohol-typed nonionic surface active agents, such as fatty acid alkanolamides, sugar esters of fatty acids, sorbitol or sorbitan esters of fatty acids; alkylamineoxides; the said alkylpolyglycosides; and others.

In the present invention, the said anionic surface active agents and nonionic surface active agents may be used alone or as a mixture of the same kind, or as a mixture of the anionic and nonionic surface active agents in combination in compliance with the applications. For example, when the detergent composition of the present invention is used in foam cleaning, an anionic surface active agent is preferably selected as the surface active agent. In particular, a mixture of alkylpolyglycoside and higher alcohol sulfate is preferably used because of its excellent foaming ability.

In addition, the blending proportion of aminodicarboxylic acid-N,N-dialkanoic acid or its salt (A) and the surface active agent in the detergent compositions of the present invention for washing light metal materials of this invention are that component A to surface active agent is between 1:2 and 4:1, and preferably between 1:1.5 and 2:1 by weight ratio. Within the above range, the present invention exhibits a remarkable effect.

Moreover, the pH value of the aqueous solution of the detergent compositions of the present invention for washing light metal materials should be set between 9 and 11, and preferably in a weak alkali state of between 9 and 10. Within this pH range, the present invention exhibits a remarkable effect.

In addition to the above-described components, the detergent composition of the present invention can contain pH buffer agents, such as alkali agents, e.g., sodium carbonate or ethanol amine, in order to maintain the pH value in the above mentioned range, and if required and necessary, can further contain hydrotrope water-soluble solvents, etc.

The above-described composition of the present invention is prepared in the form of granular powder or liquid, and is put into actual use in an appropriate concentration by diluting it with water in accordance with the degree of stains on a light metal surface to be washed, or for the purpose of foam washing, etc.

The above-described detergent composition of the present invention has excellent microbial degradability. For example, when the detergent composition is diluted with water to COD 500 ppm, and then an activated sludge is added thereto, and the resulting mixture is aerated for 7 days, the decoposition rate becomes 85% and more (COD being less than 75 ppm).

PREFERRED EMBODIMENTS OF THE INVENTION

The present invention is described in more detail by the following examples of embodiments, but it should not be understood that the invention is construed as being limited thereto. Unless otherwise indicated, % (percents) show % by weight.

Compounds used in the following examples are outlined below:

Sodium glutamic acid-N,N-diacetate: GLDA (A1)

Sodium polyoxyethylene lauryl ether acetate:

$$C_{11}O(EO)_nCH_2COONa \quad \text{(B1)}$$

The above compound with 1 mole of EO:

$$C_{12}O(EO)_1CH_2COONa \quad \text{(B1-1)}$$

The above compound with 3 moles of EO:

$$C_{12}O(EO)_3CH_2COONa \quad \text{(B1-3)}$$

The above compound with 4.5 moles of EO:

$$C_{12}O(EO)_{4.5}CH_2COONa \quad \text{(B1-4.5)}$$

Alkyl polyglycoside: APG (B2)

Sodium salt of laurylic acid (soap): $C_{12}Na$

Coco fatty acid dimethylamine oxide: AO (surface active agent)

Sodium linear alkylbenezene sulfonate: LAS (surface active agent)

Sodium ethylene diamine tetraacetate: EDTA

Sodium tripolyphosphate: STPP

Sodium carbonate: Carbonate

Sodium metasilicate: Silicate

Sodium salt of beef tallow fatty acid: Soap

Carboxymethyl cellulose: CMC

Sodium sulfate: Sulfate

Triethanol amine: TEA

Of the above compounds, GLDA which was obtained by fermenting saccharides originated from plants to synthesize L-glutamic acid, and then by cycanomethylating the said L-glutamic acid, followed by hydrolyzing the resulting product under an alkali condition is used. Components B1-1, B1-3 and B1-4.5 which were prepared by neutralizing Beaulight LH201, Beaulight LH203 and Beaulight LCA (products of Sanyo Kasei Kogyo K.K.) respectively were used. As APG, GLUCOPON 600 CS UP (GLUCOPON 600 CS UP : $R^3=C_{12-14}$, m=1.4; product of Henckel Corp.) was used. As EDTA, a compound synthesized by the conventional production method was used. As LAS, a synthetic detergent for fabric washing evaluation, sodium n-dodecylbenezenesulfonate was used. As far as STPP, silicate, carbonate, soap, CMC and sulfate are concerned, each of the reagents grade is used.

EXAMPLE 1

Each sample (detergent) shown in Table 1 was prepared. Sample Nos. 1 through 5 and Sample No. 8 were diluted with each of water containing 60 ppm and 100 ppm of calcium carbonate so that the amount of the component (B1) became 0.08% in the solution. Sample Nos. 6 and 7 were diluted with each of water containing 60 ppm and 100 ppm of calcium carbonate so that the amount of the component (B1) became 0.05%. and Sample Nos. 9 through 14 were diluted with each of water containing 60 ppm and 100 ppm of calcium carbonate so that the amount of the total components became 0.133%. The state of aqueous solution and the foaming ability of each sample thus prepared were observed. The results obtained are shown in Table 1.

Aqueous solution of each sample was adjusted to pH 12 using an alkali buffer agent, and was observed at water temperature of 25° C.

The foaming property test employed is to observe whether or not metallic soap is formed when each sample is dissolved in hard water. If foaming phenomenon is observed, it is construed that metallic soap is not formed and therefore washing effect of the sample is excellent. To the contrary, no foaming means that metallic soap is formed, and therefore washing effect of the sample is lowered. This foaming property test was conducted in such manner as 20 cc of the aqueous solution of the sample was filled in a 100 cc color comparison tube and then the filled tube was shaken up and down by hand and finally the foaming volume was compared.

TABLE 1

| Sample No. | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Component (par by weight) | | | | | | | | | | | | | | |
| $C_{12}Na$ | | | | | | | | | 60 | 60 | 60 | | | |
| $C_{12}O(EO)_1CH_2COONa$(B1-1) | 60 | | | | | | | | | | | 60 | | |
| $C_{12}O(EO)_3CH_2COONa$(B1-3) | | 60 | 60 | 60 | 60 | 40 | 40 | | | | | | 60 | |
| $C_{12}O(EO)_{4.5}CH_2COONa$(B1-4.5) | | | | | | | | 60 | | | | | | 60 |
| EDTA | | | | | | | | | | 5 | | | | |
| GLDA(A1) | 5 | 1.2 | 2.5 | 3 | 5 | 10 | 20 | 5 | | | 5 | | | |
| $Na_2CO_3$ | 35 | 38.5 | 37.5 | 37 | 35 | 50 | 40 | 35 | 40 | 35 | 35 | 40 | 40 | 40 |
| (B1)/(A1) | 12/1 | 50/1 | 24/1 | 20/1 | 12/1 | 4/1 | 2/1 | 12/1 | 1/0 | 12/1 | 12/1 | 1/0 | 1/0 | 1/0 |
| State of aqueous solution | | | | | | | | | | | | | | |
| $CaCO_3$ 60 ppm | ○ | ○ | ○ | ○ | ○ | ○ | ○ | ○ | X | X | X | ○ | ○ | ○ |
| $CaCO_3$ 100 ppm | ○ | ○ | ○ | ○ | ○ | ○ | ○ | ○ | X | X | X | Δ | Δ | Δ |
| Foaming property | | | | | | | | | | | | | | |
| $CaCO_3$ 60 ppm | ○ | ○ | ○ | ○ | ○ | ○ | ○ | ○ | X | X | X | ○ | ○ | ○ |
| $CaCO_3$ 100 ppm | ○ | ○ | ○ | ○ | ○ | ○ | ○ | ○ | X | X | X | Δ | ○ | ○ |

State of aqueous solution: ○ . . . complete transparency, Δ . . . slight turbidity, X . . . white turbidity
Foaming property: ○ . . . preferable foaming, Δ . . . foaming, X . . . no foaming As is apparent from Table 1, Sample Nos. 9, 10 and 11 have conventional washing soap compositions, and were not completely dissolved at water temperature of 25° C., and foaming was not observed.

Samples containing sodium polyoxyethylene lauryl ether acetate ($C_{12}(EO)_nCH_2COONa$) with ethylene oxide addition mole number (n) of 1 mole, 3 moles and 4.5 moles (B1-1, B1-3 and B1-4.5 respectively) were all dissolved in water under the conditions that the calcium carbonate concentration was 60 ppm and water temperature was 25° C. However, in water under the conditions that calcium carbonate concentration was 100 ppm and GLDA was not present, insoluble salts were formed. (Sample Nos. 12, 13 and 14).

Contrary to the above, when sodium polyoxyethylene lauryl ether acetate was used together with GLDA, formation of an insoluble substance was prevented even in water with 100 ppm of calcium carbonate and turbidity did not occur. Also, at that time, sufficient foaming was generated. This was well achieved particularly when the ratio of the component (B1) against the component (A1) is within the range of between 2/1 and 50/1. (Sample Nos. 1 through 8).

EXAMPLE 2

Each sample (detergent composition) shown in Table 2 was prepared. Sample Nos. 15 through 19 and 22 were diluted with each of water containing 60 ppm and 100 ppm of calcium carbonate so that the amount of component (B1) became 0.08%. Sample Nos. 20 and 21 were diluted with each of water containing 60 ppm and 100 ppm of calcium carbonate so that the amount of component (B1) became 0.05%. Sample Nos. 23 through 28 were diluted with each of water containing 60 ppm and 100 ppm of calcium carbonate so that the amount of the total components became 0.133%. Each sample was observed on the washing efficiency. The results obtained are shown in Table 2.

A washing efficiency test was conducted by employing a wet type artificial stained cloth of Sentaku Kagaku Kyokai (Association of Washing Science) as an artificial stained cloth, and by washing this stained cloth with Targo to Meter under the condition that washing temperature was 25° C., and washing time was 10 minutes, and the agitation number of a stirrer was 120 rpm, and the bath ratio was 1:30, and the repeating number of stained cloth was 5. By measuring reflectivities of original cloth, stained cloth before washing, and stained cloth after washing, washing efficiency was determined utilyzing the following equation:

Washing efficiency=[(reflectivity of stained cloth after washing)−(reflectivity of stained cloth before washing)]/[(reflectivity of original cloth)−(reflectivity of stained cloth before washing)]×100

TABLE 2

| Sample No. | 15 | 16 | 17 | 18 | 19 | 20 | 21 | 22 | 23 | 24 | 25 | 26 | 27 | 28 |
|---|---|---|---|---|---|---|---|---|---|---|---|---|---|---|
| Component (par by weight) | | | | | | | | | | | | | | |
| $C_{12}Na$ | | | | | | | | | 60 | 60 | 60 | | | |
| $C_{12}O(EO)_1CH2COONa$(B1-1) | 60 | | | | | | | | | | | 60 | | |
| $C_{12}O(EO)_3CH_2COONa$(B1-3) | | 60 | 60 | 60 | 60 | 40 | 40 | | | | | | 60 | |
| $C_{12}O(EO)_{4.5}CH_{2COONa(B1-4.5)}$ | | | | | | | | 60 | | | | | | 60 |
| EDTA | | | | | | | | | | 5 | | | | |
| GLDA(A1) | 5 | 1.2 | 2.5 | 3 | 5 | 10 | 20 | 5 | | | 5 | | | |
| $Na_2CO_3$ | 35 | 38.5 | 37.5 | 37 | 35 | 50 | 40 | 35 | 40 | 35 | 35 | 40 | 40 | 40 |
| (B1)/(A1) | 12/1 | 50/1 | 24/1 | 20/1 | 12/1 | 4/1 | 2/1 | 12/1 | 1/0 | 12/1 | 12/1 | 1/0 | 1/0 | 1/0 |

TABLE 2-continued

| Sample No. | 15 | 16 | 17 | 18 | 19 | 20 | 21 | 22 | 23 | 24 | 25 | 26 | 27 | 28 |
|---|---|---|---|---|---|---|---|---|---|---|---|---|---|---|
| washing efficiency | | | | | | | | | | | | | | |
| $CaCO_3$ 60 ppm (%) | 51.4 | 46.8 | 48.3 | 48.6 | 51.6 | 50.2 | 52.3 | 51.4 | 41.8 | 42.4 | 41.6 | 41.3 | 45.1 | 42.1 |
| $CaCO_3$ 100 ppm (%) | 50.3 | 46.3 | 46.9 | 47.1 | 48.9 | 49.1 | 50.3 | 50.6 | 42.3 | 43.0 | 42.6 | 40.2 | 44.8 | 41.0 |

As shown in Table 2, conventional washing soap compositions (Sample Nos. 23 through 25) showed the washing efficiency of between about 41 and 42% in water containing 60 ppm of calcium carbonate, and between about 42 and 43% in water containing 100 ppm of calcium carbonate. Thus, the washing efficiency showed low value in each of those samples. Further, the compositions which contained component (B1) but did not contain component (A1) (Sample Nos. 26 through 28) also showed the washing efficiency of between about 40 and 42%, which was similar to the above. Thus, those compositions show low value of washing efficiency.

Contrary to the above compositions, the compositions containing both component (A1) and (B1) (Sample Nos. 15 through 22) showed the washing efficiency of about 46 to 52% in each of water containing 60 ppm and 100 ppm of calcium carbonate, thus showing high washing efficiency.

EXAMPLE 3

Each sample (detergent) shown in Table 3 was prepared. Sample Nos. 29 through 32 and Sample Nos. 33 through 34 were diluted with water containing 60 ppm of calcium carbonate so that the amount of component (B1) became 0.08% and 0.15% respectively. After that, the washing efficiency of each sample against stains of oils and fats on a hard surface was observed and evaluated. The results obtained are shown in Table 3. An aqueous solution of each sample was adjusted to pH 8 using a weak alkali buffer agent, and was put on the washing efficiency test under a condition of water temperature of 20° C.

The washing efficiency test was conducted using a plate prepared in accordance with the method described in JIS K3370 as an artificial stained plate. The plate was washed using an improved type of Leenerts detergency tester under such conditions as the number of revolution is 250 rpm and washing time is 3 minutes. And the plate thus washed was sufficiently rinsed with water and then air-dried, and finally the washing performance was evaluated.

By measuring the weights of slide glasses before washing, after washing, and having no stain adhered thereon the washing efficiency was determined utilyzing the following equation:

Washing efficiency=[(weight of a stained plate before washing)−(weight of a stained plate after washing)]/[(weight of a stained plate before washing)−(weight of a slide glass)]×100

TABLE 3

| Sample No. | 29 | 30 | 31 | 32 | 33 | 34 |
|---|---|---|---|---|---|---|
| Component (par by weight) | | | | | | |
| $C_{12}O(EO)_3CH_2COONa$-(B1–3) | 60 | 60 | 60 | 40 | 60 | |
| LAS (surface active agent) | | 2 | | 2 | | 15 |
| AO (surface active agent) | | 1 | 2 | 1 | | |
| GLDA (A1) | 5 | 5 | 8 | 8 | | |

TABLE 3-continued

| Sample No. | 29 | 30 | 31 | 32 | 33 | 34 |
|---|---|---|---|---|---|---|
| ethanol | 5 | 5 | 5 | 5 | 5 | 5 |
| water | 30 | 27 | 25 | 24 | 35 | 80 |
| (B1)/(A1) | 12/1 | 12/1 | 15/2 | 5/1 | 1/0 | — |
| washing efficiency (%) | 46.8 | 50.2 | 53.6 | 48.4 | 31.3 | 47.2 |

As is apparent from Table 3, Sample Nos. 29 through 32 have markedly excellent washing performance against oil stains as compared with Sample No. 33, and also have the detergency equal to or higher than that of Sample No. 34 which uses a synthetic surface active agent. It was recognized from the above results that when a very small amount of a surface active agent is added to the composition of the p resent invention, the washing effect is further improved.

EXAMPLE 4

The detergent composition of Sample No. 1 shown in Table 1 was diluted with water so as to bring COD down to 500 ppm. Activated sludge was collected from an activated sludge facility where chemical industry waste water is treated. This activated sludge was supplied to a small sized three-tank series activated sludge facility of aeration type together with the above diluted solution, and the biodegradation test was conducted by aeration.

COD in the waste water thus treated for 7 or 8 days was reduced to between 50 and 75 ppm, and the rate of decomposition was between 85 and 90%.

EXAMPLE 5

Components shown in Table 4 were blended. The resulting blends were diluted with water containing 60 ppm of calcium carbonate and water containing 100 ppm of calcium carbonate to the concentrations (g/l in terms of anhydride) shown in Table 4 so that Sample Nos. 35 through 48 and Sample Nos. 49 through 56 were prepared respectively. The washing efficiency test was conducted on those Sample Nos. 35 through 56. The results obtained are shown in Table 4.

The washing efficiency test and the determination of washing efficiency were executed in the same manner as in Example 2.

TABLE 4

| Sample No. | 35 | 36 | 37 | 38 | 39 | 40 | 41 | 42 | 43 | 44 | 45 | 46 | 47 | 48 | 49 | 50 | 51 | 52 | 53 | 54 | 55 | 56 |
|---|---|---|---|---|---|---|---|---|---|---|---|---|---|---|---|---|---|---|---|---|---|---|
| Component (%) | | | | | | | | | | | | | | | | | | | | | | |
| LAS | 15 | — | — | — | — | — | — | — | — | — | — | — | — | — | 15 | — | — | — | — | — | — | — |
| APG | — | 30 | — | 8 | 22 | 15 | 15 | 15 | 15 | 20 | 20 | 20 | 41 | 31 | — | 30 | — | 8 | 22 | 15 | 20 | 31 |
| STPP | 17 | — | — | — | — | — | — | — | — | — | — | — | — | — | 17 | — | — | — | — | — | — | — |
| GLDA | — | — | 30 | 22 | 8 | 17 | 20 | 25 | 30 | 20 | 25 | 30 | 20 | 25 | — | — | 30 | 22 | 8 | 25 | 30 | 25 |
| silicate | 7 | 7 | 7 | 7 | 7 | 7 | 7 | 7 | 7 | 7 | 7 | 7 | 6 | 6 | 7 | 7 | 7 | 7 | — | — | — | 6 |
| carbonate | 3 | 3 | 3 | 3 | 3 | 3 | 3 | 3 | 3 | 3 | 3 | 3 | 31 | 31 | 3 | 3 | 3 | 3 | — | — | — | 31 |
| sulfate | 56 | 58 | 58 | 58 | 58 | 56 | 53 | 48 | 43 | 48 | 43 | 38 | — | — | 56 | 58 | 58 | 58 | 58 | 48 | 38 | — |
| concentration (g/l) | 1.3 | 1.3 | 1.3 | 1.3 | 1.3 | 1.3 | 1.3 | 1.3 | 1.3 | 1.3 | 1.3 | 1.3 | 0.7 | 0.7 | 1.3 | 1.3 | 1.3 | 1.3 | 1.3 | 1.3 | 1.3 | 0.7 |
| amount of calcium carbonate contained (ppm) | 60 | 60 | 60 | 60 | 60 | 60 | 60 | 60 | 60 | 60 | 60 | 60 | 60 | 60 | 100 | 100 | 100 | 100 | 100 | 100 | 100 | 100 |
| washing efficiency (%) | 48 | 35 | 30 | 44 | 46 | 48 | 48 | 48 | 49 | 49 | 50 | 52 | 48 | 46 | 43.0 | 30 | 28 | 40 | 39 | 43 | 44 | 40 |

The blend of each of Sample Nos. 35 and 49 shown in Table 4 is that of the standard detergent defined by JIS K3371 for determining detergency of synthetic detergent for fabrics. Sample No. 35 and 49 were prepared by diluting this blend with water containing 60 ppm and 100 ppm of calcium carbonate respectively.

In this test, in case of samples (Nos. 36 through 48) which were diluted with water containing 60 ppm of calcium carbonate and samples (Nos. 50 through 56) which were diluted with hard water containing 100 ppm of calcium carbonate, if their washing efficiencies substantially reach the standard ones of Sample No. 35 and Sample No. 49 respectively, it is judged that the washing efficiency of a sample is excellent. On the other hand, when the washing efficiency of a sample shows a considerably lower value than the relevant standard one, it is judged that the washing efficiency is poor.

The following are known from Table 4: In case of Sample Nos. 38 through 48 containing both APG (component (B2)) and GLDA (component (A1)) and diluted with washing water containing 60 ppm of calcium carbonate, their washing efficiencies are in the range of between the minimum value of 43.6% (Sample No. 38) and the maximum value of 51.5% (Sample No. 46), and are substantially comparable to the standard one of 47.7% of Sample No. 35. Therefore, it can be said that Sample Nos. 38 through 48 prepared according to the present invention are excellent in washing efficiency.

Contrary to the above, in case of Sample Nos. 36 and 37 containing either one of components APG and GLDA and diluted with washing water containing 60 ppm of calcium carbonate, their washing efficiencies are 34.8% and 30.1% respectively, and those are far behind the standard one of 47.7% of Sample No. 35. Therefore, it can be said that Sample Nos. 36 and 37 containing either one of components (A1) and (B2) prepared according to the present invention are both poor in washing efficiency.

Further, in case of Sample Nos. 52 through 56 containing both components APG and GLDA and diluted with hard water containing 100 ppm of calcium carbonate, their washing efficiencies are in the range of between the minimum value of 38.6% (Sample No. 53) and the maximum value of 43.6% (Sample No. 55), and are substantially comparable to the standard one of 43.0% of Sample No. 49. Therefore, it can be said that the detergent prepared according to the present invention is excellent in washing efficiency even when washing is conducted using hard water containing 100 ppm of calcium carbonate.

On the other hand, in case of Sample Nos. 50 and 51 containing only either one of APG and GLDA and diluted with hard water containing 100 ppm of calcium carbonate, their washing efficiencies are 30.3% and 28.4% respectively.

Thus, either washing efficiency of Samples does not reach the standard one of 43.0% of Sample No. 49 and far from it. Therefore, it can be said that Sample Nos. 50 and 51 containing either one of components (A1) and (B2) prepared according to the present invention are both poor in washing efficiency.

EXAMPLE 6

GLDA was added to a 0.15% aqueous solution of APG, followed by mixing, to prepare a sample aqueous solution (pH=11) containing 0.1% of GLDA on W/V % basis. Microbial degradability test was conducted in the same manner as has been done in Example 4. As a result, after passing 7 or 8 days, COD in the test sample was lowered to between 50 and 75 ppm, and the rate of decomposition was between 85 and 90%

EXAMPLE 7

Sodium L-glutamic acid-N,N-diacetate (GLDA) and sodium ethylene diamine tetraacetate (EDTA) as chelating agents were added to a 0.15% aqueous solution of APG, followed by mixing, to prepare sample aqueous solutions so that each sample has the respective pH value shown in Table 5 and contains 0.1 W/V % of the above chelating agents in total. The calcium chelating value (CV value) of each aqueous solution was measured.

Measurement of CV values was conducted by means of a photometric titration using an automatic titration device. That is, 100 ml of each sample aqueous solution described above was filled in a 200 ml beaker. 5 ml of 1% sodium laurate aqueous solution and 10 ml of isopropyl alcohol were added as indicators to each sample aqueous solution. Titration was conducted with an automatic titration device equipped with a photometric titration electrode using 0. 01M calcium acetate aqueous solution as a titrating solution. The calcium ion chelating value per 1 g of GLDA or 1 g of EDTA was shown in terms of mg number of calcium carbonate. The results of the measurement are shown in Table 5.

TABLE 5

| pH in sample | chelating value (CV value) ($CaCO_3$ mg/g) | |
|---|---|---|
| aqueous solution | GLDA | EDTA |
| 8.0 | 126 | 277 |
| 9.0 | 220 | 277 |
| 10.0 | 236 | 278 |
| 11.0 | 278 | 279 |
| 12.0 | 292 | 281 |

As is apparent from Table 5, the calcium ion capturing power of the samples containing GLDA prepared according to the present invention was markedly increased under weak alkali conditions of pH of between 9 and 12, and was substantially comparable to that of the conventional chelating agent EDTA.

EXAMPLE 8

Each GLDA and EDTA was added as a chelating agent to 0.15% aqueous solution of polyoxyethylenealkylether-typed nonionic surface active agent (ADEKATOL SO 135, a product of Asahi Denka Kogyo K. K.), followed by mixing, to prepare aqueous solutions containing 0.2 W/V % of either one of the above chelating agents. The corrosion test on aluminum was conducted with those aqueous solutions.

The corrosion test was conducted as follows: 0.2M sodium carbonate and 0.2M sodium bicarbonate were added to the above aqueous solutions containing 0.2 W/V % of either one of the above chelating agents, followed by mixing, to prepare sample aqueous solutions having the respective pH value as shown in Table 6.

An aluminum plate with the surface being previously cleaned and the weight being previously measured was dipped in each of the aqueous solutions having the respective pH value obtained above at water temperature of 25° C. for 8 hours. The aluminum plate was then taken out of the aqueous solution, and washed with water, and dried. The weight of the aluminum plate was measured. The difference of weights before and after dipping was obtained as the rate of corrosion (%). The results obtained are shown in Table 6.

TABLE 6

| pH in sample | percentage of corrosion | |
|---|---|---|
| aqueous solution | GLDA | EDTA |
| 8.0 | 0.21 | 0.36 |
| 9.0 | 0.24 | 0.44 |
| 10.0 | 0.27 | 0.57 |
| 11.0 | 0.92 | 1.46 |

It is apparent from the results shown in Table 6 that corrosiveness to an aluminum material of samples containing GLDA prepared according to the present invention is markedly small in any pH values as compared with those of any samples containing EDTA.

EXAMPLE 9

Removal test of stains of oils and fats was conducted with sample aqueous solutions having the respective pH value as shown in Table 7.

The removal test of stains of oils and fats was conducted as follows:

0.2M sodium carbonate and 0.2M sodium bicarbonate were added to aqueous solutions containing 0.2 W/V % of a chelating agent (GLDA or EDTA) and 0.05 W/V % of polyoxyehtylenealkylether-typed nonionic surface active agent respectively, followed by mixing, to prepare sample aqueous solutions having the respective pH value as shown in Table 7.

Separately, a stainless steel plate with stains of beef tallow on its surface (test piece) was prepared as follows. Beef tallow was dissolved in the same amount of chloroform. A stainless steel plate with the surface being previously cleaned and the surface luster being previously measured, was dipped in the solution prepared above. The plate was taken out of the solution, and then dried to evaporate chloroform, thereby preparing a test piece.

The thus obtained stainless steel plate having beef tallow adhered thereon (test piece) was dipped in each of the sample aqueous solutions having the respective pH value obtained above at water temperature of 25° C. for 15 minutes.

The stainless steel plate was taken out of the aqueous solution, and lightly washed in a still water in an overflow state. After drying the plate overnight at a room temperature, the washing state of the surface of the stainless steel plate was judged.

The judgement of the washing state was made by measuring glossiness of a test piece before washing and after washing, and then by calculating the washing efficiency (%) utilyzing the following equation:

Washing efficiency (%)=[(glossiness after washing)−(glossiness before washing)]/[(glossiness of clean stainless steel plate)−(glossiness before washing)]×100

The polyoxyethylene alkylether-typed nonionic surface active agent used in this example was ADEKATOL SO 135 (a product of Asahi Denka Kogyo K.K.). The measurement results obtained are shown in Table 7.

TABLE 7

| pH in sample | washing efficiency (%) | |
|---|---|---|
| aqueous solution | GLDA | EDTA |
| 8.0 | 11.2 | 15.6 |
| 9.0 | 20.4 | 15.6 |
| 10.0 | 22.8 | 14.6 |
| 11.0 | 46.8 | 10.1 |

As is apparent from Table 7, the washing properties against beef tallow of the samples containing GLDA prepared according to the present invention were markedly excellent in the pH range of between 9 and 11 as compared with those of the samples containing EDTA.

EXAMPLE 10

Sample Nos. 57 through 61 shown in Table 8 were prepared. Removal test of stains of oils and fats was conducted on each of the sample aqueous solutions. The pH values in the sample aqueous solutions were all 10.

Each sample aqueous solution was prepared as follows: 0.5% aqueous solution of each of the compositions shown in Table 8 was prepared. 0.2M sodium carbonate and 0.2M sodium bicarbonate were added to each sample aqueous solution, followed by mixing. The pH was adjusted to 10 to prepare each sample aqueous solution.

The test piece having stains of beef tallow thereon prepared by the same manner as in Example 9 was dipped in each of the sample solutions, and the washing state was judged in the same manner as in Example 9. Thus, removal property of stains of oils and fats was tested. The results obtained are shown in Table 8.

TABLE 8

| Sample No. | 57 | 58 | 59 | 60 | 61 |
|---|---|---|---|---|---|
| Component (g) | | | | | |
| LAS | — | — | 5 | 5 | 5 |
| GLDA | 20 | — | — | 10 | 20 |
| EDTA | — | 20 | — | — | — |
| sodium sulfate | 80 | 80 | 95 | 85 | 75 |
| washing efficiency (%) | 4.1 | 3.8 | 5.7 | 24.5 | 44.6 |

As is apparent from Table 8, the washing property against beef tallow stain was markedly improved by the use of LAS and GLDA in combination (Sample Nos. 60 and 61).

EXAMPLE 11

Sample Nos. 62 through 66 containing the respective component (%) shown in Table 9 were prepared. Each sample was diluted with water containing 50 ppm and 70 ppm of calcium carbonate to prepare 2% detergent aqueous solutions. Transparency of those aqueous solutions was visually observed, thereby judging stability of the aqueous solution when diluted with water having each hardness. The results obtained are shown in Table 9.

TABLE 9

| Sample No. | 62 | 63 | 64 | 65 | 66 |
|---|---|---|---|---|---|
| Component (g) | | | | | |
| LAS | 5 | 5 | 5 | 5 | 5 |
| AO | — | — | — | 2 | 2 |
| GLDA | — | 2 | 3 | 2 | 3 |
| TEA | 3 | 3 | 3 | 3 | 3 |
| city water | balance | balance | balance | balance | balance |
| Total | 100 | 100 | 100 | 100 | 100 |
| stability of aqueous solution | | | | | |
| 50 ppm of $CaCO_3$ contained | trans-parent | trans-parent | trans-parent | trans-parent | trans-parent |
| 70 ppm of $CaCO_3$ contained | white turbidity | trans-parent | trans-parent | trans-parent | trans-parent |

As is apparent from Table 9, in Sample No. 62 which did not contain GLDA, turbidity (white turbidity) occurred when water contained 70 ppm of calcium carbonate. Contrary to this, in each of Sample Nos. 63 through 66 (prepared according to the present invention) transparency was maintained, and they were all stable even if diluted with water having high hardness.

Furthermore, 2% aqueous solution of each of Sample Nos. 62 through 66 was sprayed to a vertical hard surface by means of foaming spray. As a result, Sample No. 62 which showed turbidity was extremely poor in foaming ability as compared with transparent dilute aqueous solutions (Sample Nos. 63 through 66).

EXAMPLE 12

A 0.5% aqueous solution of the detergent composition comprising 5% of LAS, 20% of GLDA and 75% of sodium sulfate was adjusted to each of pH values shown in Table 10 to obtain Sample Nos. 67 through 71. Removal property of stains of oils and fats was evaluated and corrosion test against aluminum was conducted on each of the samples.

pH values of the samples were adjusted by adding each of 0.2M sodium carbonate, 0.2M sodium bicarbonate, and 0.2m sodium hydroxide to each sample, followed by mixing the resulting mixture.

The removal property of stains of oils and fats was evaluated by preparing a test piece having stains of oils and fats prepared in the same manner as in Example 9, and dipping it in each sample with water temperature of 25° C. for 15 minutes, and then picking up it, and finally calculating the washing efficiency (%) in the same manner as in Example 9.

The corrosion test on aluminum was conducted by measuring the weight of an aluminum plate with the surface being previously cleaned, and dipping it in each sample in the same manner as in Example 8, and then obtaining the rate of corrosion (%). At the same time, the surface state of aluminum was observed.

The results obtained are shown in Table 10. In Table 10, the mark ○ shows that aluminum surface did not change and retains luster, and the mark Δ shows that luster of the surface was somewhat decreased, but there is no problem on practical use, and X shows that surface corrosion was observed, and the surface was whitened.

TABLE 10

| Sample No. | 67 | 68 | 69 | 70 | 71 |
|---|---|---|---|---|---|
| pH value | 8.0 | 9.0 | 10.0 | 11.0 | 12.0 |
| washing efficiency (%) | 29.1 | 34.9 | 36.2 | 39.5 | 42.8 |
| percentage of corrosion (%) | 0.07 | 0.09 | 0.09 | 0.38 | 0.57 |
| state of surface | ○ | ○ | ○ | Δ | X |

It is understood from the results of Table 10 that, regarding the removal property of stains of oils and fats, Sample No.67 (pH 8) is slightly poor, but Sample Nos. 68 through 71 shows increased detergency when at pH of 9 and more.

Regarding corrosion against aluminum, in Sample No. 71 (pH 12) corrosion was observed on the surface of an aluminum plate, and the surface was whitened. On the other hand, in Sample Nos. 67 through 69, no change was observed on the surface of aluminum plate when at pH of less than 10, and the surface retained luster. In Sample No. 70 (i.e. at pH 11), luster of the aluminum plate surface was somewhat decreased when at pH of less than 10, but it was judged that there is no problem for practical use.

It is concluded from the above results that in Sample Nos. 68 through 70, if the pH values of detergent aqueous solutions are in the range of between 9 and 11, the removal properties of stains of oils and fats are excellent, and no change on the aluminum plate surface was observed. Accordingly a detergent aqueous solution has excellent detergency, and does not substantially affect the aluminum material, at the above-mentioned pH range, which is concluded to be preferred range of the present invention.

EXAMPLE 13

Detergent compositions containing the respective component (%) shown in Table 11 were each diluted with water containing 100 ppm of calcium carbonate to prepare 2% detergent aqueous solutions, thereby obtaining Sample Nos. 72 through 74. Each of those samples was sprayed on the surface of an aluminum plate for 5 hours, and the state of the aluminum plate surface was visually observed.

TABLE 11

| Sample No. | 72 | 73 | 74 |
|---|---|---|---|
| Component (g) | | | |
| LAS | 8 | 8 | 8 |
| GLDA | — | — | 5 |
| EDTA | — | 5 | — |
| TEA | 5 | 5 | 5 |
| city water | balance | balance | balance |
| foaming state | no foaming | preferable foaming | preferable foaming |
| state of the Al plate surface | no problem | whitened and corrosion occurred | no foaming |

From the results shown in Table 11, in Sample No.72 which does not contain chelating agents (EDTA and GLDA), the foaming state is poor. Further, in Sample No.73 using EDTA as a chelating agent, the foaming state is improved, but corrosion on the surface of aluminum plate occurs. On the other hand, in Sample No. 74 using GLDA as a chelating agent, the foaming state and surface state of aluminum plate are good.

EXAMPLE 14

An aqueous solution containing 0.5% of the composition comprising 5 parts by wight of LAS, 10 parts by weight of GLDA and 85 parts by weight of sodium sulfate was prepared. Next, 0.2M sodium carbonate and 0.2M of sodium hydrogencarbonate were each added to this aqueous solution, followed by mixing, to adjust the aqueous solution to have pH of 10.0 (Sample No. 60 in Table 8). Microbial degradability test was conducted using this aqueous solution in the same manner as in Example 4. As a result, after passing 7 to 8 days, COD in the test sample was reduced to the range of between 50 and 75 ppm, and the rate of decomposition was recorded as being in the range of between 85 and 90%.

EXAMPLE 15

Components shown in Table 12 were blended, and the resulting blends were diluted with water each containing 60 ppm and 100 ppm of calcium carbonate into the respective concentration (g/l, in terms of anhydride) shown in Table 13, thereby preparing Sample Nos. 75 through 80.

The washing efficiency test was conducted on those Sample Nos. 75 through 80. The results obtained are shown in Table 12.

The washing efficiency test was conducted in the same manner as in Example 2.

The blend of Sample No. 75 shown in Table 12 is that of the standard detergent determining detergency as synthetic detergent for washing fabrics defined by JIS K3371.

In this test, when the washing efficiency of a sample is found to almost reach the standard washing efficiency value of Sample No. 75, it is judged that the washing efficiency of the sample is excellent, and when the washing efficiency of a sample is considerably lower than the standard one, it is judged that the washing efficiency of the sample is poor.

TABLE 12

| Sample No. | 75 | 76 | 77 | 78 | 79 | 80 |
|---|---|---|---|---|---|---|
| blending proportion | | | | | | |
| component(B)/component(A) | — | 1/3 | 1/2 | 1 | 2 | 3 |
| component(B1-3)/component(B2) | —/— | 20/80 | 30/70 | 50/50 | 70/30 | 80/20 |
| composition | | | | | | |
| GLDA(A1) | — | 25.0 | 25.0 | 23.0 | 20.0 | 20.0 |
| LAS | 15.0 | — | — | — | — | — |
| B1-3 | — | 1.67 | 3.75 | 11.5 | 28.0 | 48.0 |
| B2 | — | 6.66 | 8.75 | 11.5 | 12.0 | 12.0 |
| STPP | 17.0 | — | — | — | — | |
| silicate | 7.0 | 7.0 | 7.0 | 7.0 | 7.0 | 7.0 |
| carbonate | 3.0 | 3.0 | 3.0 | 3.0 | 3.0 | 3.0 |
| soap | 1.0 | 1.0 | 1.0 | 1.0 | 1.0 | 1.0 |
| CMC | 1.0 | 1.0 | 1.0 | 1.0 | 1.0 | 1.0 |
| sulfate | 56.0 | 54.67 | 50.5 | 42.0 | 28.0 | 28.0 |
| concentration (g/l) | 1.33 | 1.33 | 1.33 | 1.33 | 1.33 | 1.33 |
| washing efficiency | | | | | | |
| 60 ppm | 47.7 | 49.2 | 49.1 | 49.1 | 49.6 | 51.6 |
| 100 ppm | 43.0 | 46.0 | 45.4 | 45.9 | 46.2 | 48.7 |

From Table 12, the washing efficiency of compositions containing three components, i.e., GLDA, and both B2 (APG) and B1-3 ($C_{12}O(EO)_3CH_2COONa$) as the surface active agents, as well as a component prepared according to the present invention, are comparable, in any of the compositions, to the standard washing efficiency of 47.7% of Sample No. 75 under the condition of washing water containing 60 ppm of calcium carbonate, and moreover showed a value higher than the standard washing efficiency of 43.0% of Sample No. 75 under the condition of washing water containing 100 ppm of calcium carbonate. Therefore, it can be said that Sample Nos. 76 through 80 prepared according to the present invention are compositions which have extremely excellent washing performance.

INDUSTRIAL APPLICABILITY

As described above, the detergent compositions according to the present invention use aminodicarboxylic acid-N,N-dialkanoic acid or its salts, in particular, an alkali salt of glutamic acid-N,N-diacetic acid which has microbial degradability as the chelating agent, and maintain water solubility under low temperature conditions, and has large sequestration, and also use a synthetic surface active agent which has microbial degradability. As a result, the detergent compositions of the present invention have the following effects:

(1) The compositions have excellent detergency, particularly showing excellent detergency even in water with high hardness, and is applied as a detergent for fabrics;

(2) The compositions have excellent microbial degradability. As a result, waste water treatment by microorganisms, such as activated sludge, is completely performed, and thus environmental pollution does not occur;

(3) The detergent compositions using an alkali salt of polyoxyethylene alkylether acetic acid (B1) as a synthetic surface active agent having microbial degradability, maintain water solubility even under low temperature conditions, and show excellent washing effect without forming a water-insoluble metallic soap. Therefore, it is not necessary to pay any specific attention to water temperature in washing, times of rinsing, and the amount of rinsing water;

(4) The detergent compositions using alkyl polyglycoside (B2) as a synthetic surface active agent having microbial degradability enable to use reclaimable or recoverable materials as starting material sources, contrary to the conventional detergent compositions which consume unreclaimable or unrecoverable petroleum resources as staring material sources. Thus, detergent compositions of the present invention are useful for conservation of resources, and are fitted to the demand in future age;

(5) The detergent compositions using anionic or nonionic surface active agent as a synthetic surface active agent having microbial degradability have such characteristics as excellent removal property of oils and fats, little influence to light metal materials including aluminum, and excellent foaming property. Therefore the detergent compositions of the present invention are suitable also for foam washing and for light metal washing.

What is claimed is:

1. A detergent composition comprising an aminodicarboxylic acid-N,N-dialkanoic acid or its salt (component A) represented by the following formula:

$$MOOC—CHZ^1—NZ^2Z^3$$

wherein each of $Z^1$, $Z^2$ and $Z^3$ independently represents a COOM-containing group, and M represents a hydrogen atom, sodium, potassium, amine or ammonium ion; and a synthetic surface active agent having microbial degradability selected from the group consisting of an alkali salt of polyoxyalkylene alkyl ether acetic acid, and alkyl polyglycoside, and mixtures thereof (component B).

2. The detergent composition according to claim 1, wherein the rate of decomposition of the detergent composition when said composition is diluted with water to COD 500 ppm, an activated sludge is added thereto and then the resulting mixture is aerated for 7 days is 85% and more (COD being less than 75 ppm).

3. The detergent composition according to claim 1, wherein the component A is an alkali salt of glutamic acid-N,N-diacetic acid.

4. The detergent composition according to claim 1, wherein the detergent composition is for washing fabrics.

5. The detergent composition according to claim 1, wherein an alkali salt of polyoxyalkylene alkylether acetic acid is selected from the group consisting of compounds represented by the following formula (1), $$RO(\underset{\underset{R^1}{|}}{C}HCH_2O)_nCH_2COOM^2 \quad (1)$$

wherein R represents an alkyl group having the carbon number of between 6 and 20, and $R^1$ represents a hydrogen atom or methyl group, and $M^2$ represents a sodium, potassium, amine or ammonium ion, and n is the number of between 1 to 6.

6. The detergent composition according to claim 1, wherein the alkyl polyglycoside is selected from the group consisting of compounds represented by the following formula:

$$RO—Z^4$$

wherein R represents an alkyl group having the carbon number of between 6 and 20, and $Z^4$ represents a polyglycosyl group having the hexose and/or pentose unit of between 1 and 3.

7. The detergent composition according to claim 1, wherein the composition contains against 1 part by weight of an alkali salt of aminodicarboxylic acid-N,N-dialkanoic acid:

(1) an alkali salt of polyoxyalkylene alkylether acetic acid in the amount of between 2 and 50 parts by weight;

(2) an alkyl polyglycoside in the amount of between ⅓ and 3 parts by weight; or (3) a mixture of an alkali salt of polyoxyalkylene alkylether acetic acid and alkyl polyglycoside in the amount of between ⅓ and 50 parts by weight, if in said mixture the proportion (weight ratio) of an alkali salt of polyoxyalkylene alkylether acetic acid to alkyl polyglycoside is between 20 to 80 and 80 to 20.

8. The detergent composition according to claim 1, wherein the composition is for washing a light metal.

9. The detergent composition according to claim 8 wherein the detergent composition for washing a light metal comprises an alkali salt of aminodicarboxylic acid-N,N-dialkanoic acid, and synthetic anionic and/or nonionic surface active agent having microbial degradability.

10. The detergent composition according to claim 9, wherein the blending proportion of an alkali salt of aminodicarboxylic acid-N,N-dialkanoic acid to synthetic anionic and/or nonionic surface active agent is between 1 to 2 and 4 to 1 in weight ratio.

11. The detergent composition according to claim 9, wherein the solution of the detergent composition has a pH value in the range of between 9 and 11.

12. The detergent composition according to claim 9, wherein the detergent composition is used for foam cleaning.

* * * * *